US008544378B2

(12) United States Patent
Kim

(10) Patent No.: US 8,544,378 B2
(45) Date of Patent: Oct. 1, 2013

(54) HYDRAULIC SYSTEM FOR CONSTRUCTION EQUIPMENT HAVING FLOAT FUNCTION

(75) Inventor: Jin Wook Kim, Changwon-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 646 days.

(21) Appl. No.: 12/794,976

(22) Filed: Jun. 7, 2010

(65) Prior Publication Data

US 2010/0313557 A1 Dec. 16, 2010

(30) Foreign Application Priority Data

Jun. 16, 2009 (KR) ..... 10-2009-0053155

(51) Int. Cl.
*F15B 11/08* (2006.01)

(52) U.S. Cl.
USPC ..... 91/437; 91/445; 91/461

(58) Field of Classification Search
USPC ..... 60/429, 462; 91/45, 426, 461, 445, 91/437
See application file for complete search history.

(56) References Cited

U.S. PATENT DOCUMENTS 5,826,486 A * 10/1998 Shimada ..... 91/436
6,405,633 B1 * 6/2002 Dueckinghaus et al. ..... 91/436
6,820,355 B2 * 11/2004 Yoshino et al. ..... 37/348
6,836,981 B2 * 1/2005 Yoshino et al. ..... 37/348

FOREIGN PATENT DOCUMENTS

KR 10-0876980 * 12/2008

OTHER PUBLICATIONS

KR10-0876980 (also called KR10-2004-0093891) Full machine translation from KIPO.*

* cited by examiner

*Primary Examiner* — Edward Look
*Assistant Examiner* — Michael Quandt
(74) *Attorney, Agent, or Firm* — Ladas & Parry LLP

(57) ABSTRACT

A hydraulic system for construction equipment having a float function is provided. The hydraulic system can perform ground leveling as making a boom descend due to its own weight without using hydraulic fluid that is discharged from a hydraulic pump. The hydraulic system includes a holding logic poppet mounted in the float valve to prevent an abrupt descending of the boom due to leakage of the hydraulic fluid through a flow path between the main control valve and the float valve during the operation of the boom cylinders.

1 Claim, 3 Drawing Sheets

HYDRAULIC SYSTEM FOR CONSTRUCTION EQUIPMENT HAVING FLOAT FUNCTION

CROSS-REFERENCE TO RELATED APPLICATION

This application is based on and claims priority from Korean Patent Application No. 10-2009-53155, filed on Jun. 16, 2009 in the Korean Intellectual Property Office, the disclosure of which is incorporated herein in its entirety by reference.

BACKGROUND OF THE INVENTION

1. Field of the Invention

The present invention relates to a hydraulic system for construction equipment that can perform ground leveling using an excavator.

More particularly, the present invention relates to a hydraulic system for construction equipment having a float function, which can perform ground leveling as making a boom descend due to its own weight without using hydraulic fluid that is discharged from a hydraulic pump.

2. Description of the Prior Art

Generally, in the case of performing the ground leveling work using an excavator, the primary purpose of a float valve is to return hydraulic fluid to a hydraulic tank by making flow paths of a large chamber side and a small chamber side of boom cylinders communicate with each other during a boom-down operation.

In this case, the boom descends due to its own weight, and is moved up and down depending upon the shape of the ground by the operation of an arm in a state where each hydraulic cylinder carries a low load to facilitate the ground leveling work. Also, the hydraulic fluid that is discharged from the hydraulic pump can be used for other working devices, and thus energy can be saved.

A hydraulic system having a float function is provided with an anti-drop valve connected to the boom cylinder to prevent the drop of the boom, a float valve, and a main valve. Due to this construction, it is difficult to match the three valves in the equipment, and hydraulic pipes for connecting the valves are increased to cause the increase of the manufacturing cost.

As shown in FIG. 1, a hydraulic system for construction equipment having a float function in the related art includes first and second hydraulic pumps 51 and 52 and a pilot pump 53; an operation lever (RCV) 58 which outputs an operation signal in proportion to an amount of operation; a float function switch (not illustrated) which selects a float function; a swing spool 54-4, an option spool 54-5, an arm spool 54-6, and a traveling spool 54-7 which are installed in a discharge flow path of the first hydraulic pump 51, and are shifted by pilot signal pressure from the pilot pump 53 according to the operation of the operation lever 58 to control hydraulic fluid supplied from the first hydraulic pump 51 to a swing device, an option device, an arm cylinder, and a traveling device, respectively; a boom spool 54-1, a bucket spool 54-2, and a traveling spool 54-3 which are installed in a discharge flow path of the second hydraulic pump 52, and are shifted by the pilot signal pressure from the pilot pump 53 according to the operation of the operation lever 58 to control hydraulic fluid supplied from the second hydraulic pump 52 to boom cylinders 55 and 55*a*, a bucket cylinder, and the traveling device, respectively; anti-drop valves 56 and 56*a* which are mounted on the boom cylinders 55 and 55*a*, respectively, to prevent the dropping of the boom; a solenoid valve 57 which is installed in a flow path between the operation valve 58 and the boom spool 54-1 to be shifted when the float function switch (not illustrated) is turned on; and a float valve 59 which is installed in a flow path between the boom spool 54-1 and the boom cylinders 55 and 55*a*, and is shifted by pilot signal pressure applied through the solenoid value 57 when the operation lever 58 is operated to make the boom descend in a state where the float function switch is turned on, so that the float valve 59 makes flow paths of large chambers and small chambers of the boom cylinders 55 and 55*a* communicate with each other to return the hydraulic fluid to a hydraulic tank.

A) A boom-down operation accompanied with no float function will be described.

In the case of operating the operation lever 58 to a boom-down side, the pilot signal pressure from the pilot pump 53 is supplied through a flow path 60, the operation lever 58, and a flow path 62, and is branched to flow paths 63 and 64.

The pilot signal pressure in the flow path 63 shifts spools of the anti-drop valves 56 and 56*a*, and the pilot signal pressure in the flow path 64 is supplied through the solenoid valve 57 (i.e. through the spool as illustrated in FIG. 1), and shifts the boom spool 54-1 in the right direction as shown in the drawing.

Accordingly, the hydraulic fluid discharged from the second hydraulic pump 52 passes through the boom spool 54-1, is discharged to a port A of the main control valve (MCV) 54, and then is supplied to the small chambers of the boom cylinders 55 and 55*a*. At this time, the hydraulic fluids which have returned from the large chambers of the boom cylinders 55 and 55*a* join together in a flow path 66 via the shifted spools of the anti-drop valves 56 and 56*a*.

The hydraulic fluid in the flow path 66 is connected to the port A of the float valve 59 to be branched, is connected to a port B of the main control valve 54 via the shifted boom spool 54-1, and then returns to a hydraulic pump 74 via an internal path of the main control valve 54.

Accordingly, the boom cylinders 55 and 55*a* are contracted.

B) A boom-down operation accompanied with a float function will be described.

As shown in FIG. 1, when the float function switch is turned on, the solenoid valve 57 is shifted in downward direction as shown in the drawing by an electrical signal from the float function switch. Accordingly, in the case of operating the operation lever 58 to a boom-down side, the pilot signal pressure from the pilot pump 53 is supplied through the flow path 60, the operation lever 58, and the boom-down side flow path 62, and is branched to the flow paths 63 and 64.

As described above, the pilot signal pressure in the flow path 63 shifts the spools of the anti-drop valves 56 and 56*a*, and the pilot signal pressure in the flow path 64 is supplied through the solenoid valve 57 which has been shifted in the downward direction as shown in the drawing, and shifts a float spool 67 of the float valve 59 in the left direction as shown in the drawing.

At this time, a part of the hydraulic fluid from the second hydraulic pump 52 is supplied via the shifted boom spool 54-1, is discharged to the port A of the main control valve 54, and then is supplied to the small chambers of the boom cylinders 55 and 55*a*. At the same time, a part of the hydraulic fluid from the second hydraulic pump 52 is connected to the port B of the shifted float valve 59.

The hydraulic fluids which have returned from the boom cylinders 55 and 55*a* join together in the flow path 66 via the shifted spools of the anti-drop valves 56 and 56*a*. A part of the hydraulic fluid in the flow path 66 is connected to the port A of the float valve 59 which has been shifted in the left direction as shown in the drawing, and a part of the hydraulic fluid in the flow path 66 is connected to the branched port B of the main control valve 54 and returns to the hydraulic pump 74 via the shifted boom spool 54-1 and the internal path of the main control valve 54.

A part of the hydraulic fluid which has flowed into the port A of the float valve 59 joins again a part of the hydraulic fluid which have been supplied to the small chambers of the boom cylinders 55 and 55*a*, i.e. the hydraulic fluid which has flowed into the port B of the float valve 59 after passing through an orifice 68 formed in the float spool 67 of the float valve 59. The joined hydraulic fluid passes through an orifice 68*a* formed in the float spool 67, and returns to the hydraulic tank 74 via a tank line 69.

Accordingly, the boom cylinders 55 and 55*a* are contracted.

As described above, a part of the hydraulic fluid returning from the large chambers of the boom cylinders 55 and 55*a* directly returns to the hydraulic tank 74 through the port B of the main control valve 54. Also, a part of the hydraulic fluid returning from the large chambers of the boom cylinders 55 and 55*a* joins again the hydraulic fluid on the small chamber side of the boom cylinders 55 and 55*a* in the float valve 59, and then returns again to the hydraulic tank 74.

As described above, since the hydraulic fluid supplied to the small chambers of the boom cylinders 55 and 55*a* and the hydraulic fluid returning from the large chambers join together in the float valve 59 and are connected to the tank line 69 during the boom-down operation, the floating function depending upon the ruggedness state of the ground can be performed with low load pressure.

On the other hand, the load pressure can be adjusted in accordance with the size of the orifices 68 and 68*a* formed inside the float valve 59. In the case of the boom-down operation after the float function switch is operated, the hydraulic fluid of the hydraulic pump is controlled to be intercepted, and thus the boom descending and the float function by the weights of the boom cylinders 55 and 55*a* themselves can be performed.

As described above, the hydraulic system in the related art controls the three kinds of valves including the main control valve 54, a pair of anti-drop valves 56 and 56*a*, and the float valve 59 in order to perform the boom float function.

Due to this, the operability of the whole equipment should be evaluated by combining the respective valve control functions in matching the operational performance of the equipment, and thus it is difficult to control the equipment. Also, since the hydraulic line connection pipes are increased due to many kinds of valves, the manufacturing cost is also increased.

SUMMARY OF THE INVENTION

Accordingly, the present invention has been made to solve the above-mentioned problems occurring in the prior art while advantages achieved by the prior art are maintained intact.

An embodiment of the present invention relates to a hydraulic system for construction equipment having a float function, which can make the structure of valves and hydraulic pipes compact without the necessity of installing anti-drop valves in boom cylinders when ground leveling is performed using an excavator.

In an embodiment of the present invention, there is provided a hydraulic system for construction equipment having a float function, which includes first and second hydraulic pumps and a pilot pump; an operation lever which outputs an operation signal in proportion to an amount of operation; a float function switch which selects a float function; an arm cylinder, a swing device, and a traveling device which are connected to the first hydraulic pump; boom cylinders, a bucket cylinder, and a traveling device which are connected to the second hydraulic pump; a main control valve which is installed in a discharge flow path of the first and second hydraulic pumps, and includes a boom spool that controls a start, stop, and direction change of the boom cylinders when the main control valve is shifted; a solenoid valve which is shifted when the float function switch is turned on; a float valve which is installed in a flow path between the boom spool and the boom cylinders, and is shifted by pilot signal pressure, which is applied when the operation lever is operated to make the boom descend in a state where the float function switch is turned on, to make flow paths on the large chamber side and the small chamber side of the boom cylinders communicate with each other so as to return the hydraulic fluid to a hydraulic tank; and a holding logic poppet which is mounted in the float valve to prevent an abrupt descending of the boom due to leakage of the hydraulic fluid through a flow path between the main control valve and the float valve during the operation of the boom cylinders.

In the preferred embodiment of the present invention, the holding logic poppet has an inlet side that is joint-connected to the flow path on the large chamber side of the boom cylinders and an outlet side that is joint-connected to a logic path of the float valve, and is seated to intercept the logic path by a pressure difference due to a difference in cross-sectional area between upper and lower end parts of a poppet and an elastic force of a valve spring that elastically supports the upper end part of the poppet.

With the above-described construction, the hydraulic system for construction equipment having a float function according to an embodiment of the present invention has the following advantages.

Since anti-drop valves for preventing the dropping of the boom cylinders are not used when ground leveling is performed using an excavator, it is not necessary to install devices and hydraulic pipes for connecting the anti-drop valves and the hydraulic cylinders and hydraulic pipes for connecting the anti-drop valves and the float valve, and thus the manufacturing cost can be reduced.

Since the valves become compact through integration of the float and holding functions, the layout of the equipment can be easily designed.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 3:
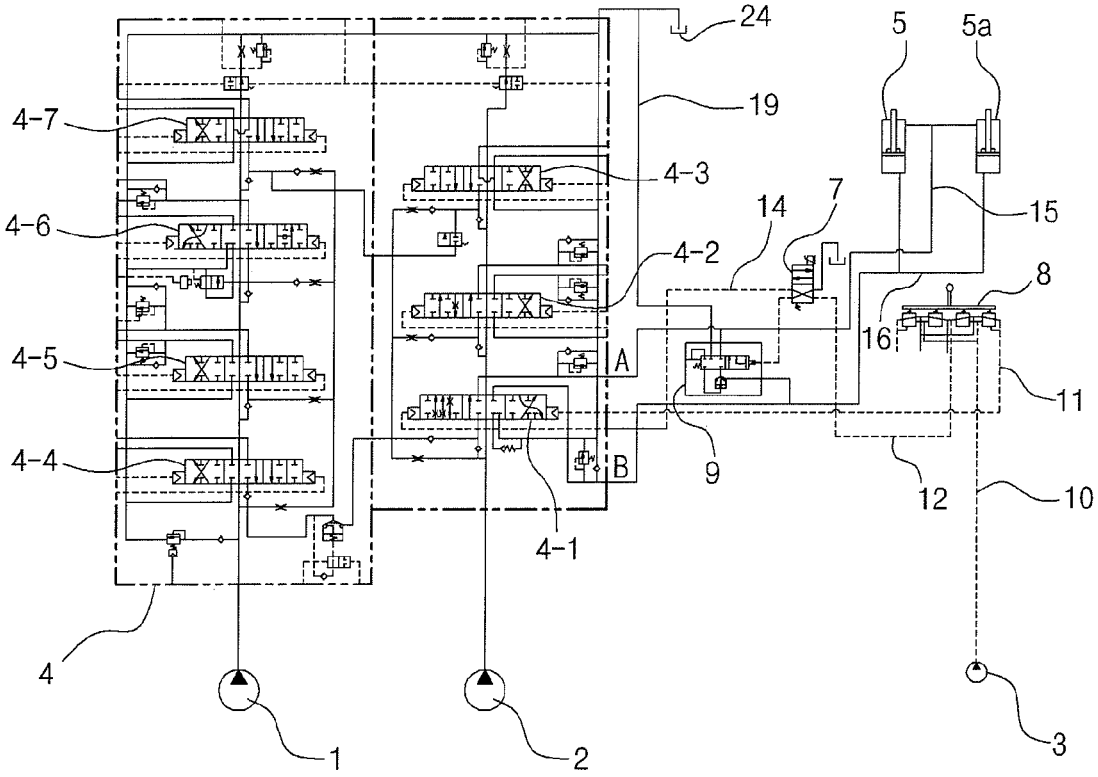
FIG. 3 is a hydraulic circuit diagram of a hydraulic system for construction equipment having a float function according to an embodiment of the present invention.
Figure 4:
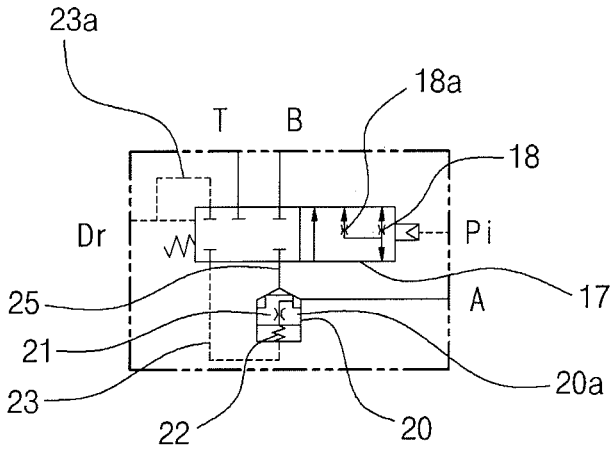
FIG. 4 is an enlarged view of a float valve as illustrated in FIG. 3.

As shown in FIGS. 3 and 4, a hydraulic system for construction equipment having a float function according to an embodiment of the present invention includes first and second hydraulic pumps 1 and 2 and a pilot pump 3; an operation lever (RCV) 8 which outputs an operation signal in proportion to an amount of operation; a float function switch (not illustrated) which selects a float function; an arm cylinder, a swing device, and a traveling device which are connected to the first hydraulic pump 1; boom cylinders 5 and 5*a*, a bucket cylinder, and a traveling device which are connected to the second hydraulic pump 2; a main control valve 4 which is installed in a discharge flow path of the first and second hydraulic pumps 1 and 2, and includes a boom spool 4-1 that controls a start, stop, and direction change of the boom cylinders 5 and 5*a* when the main control valve is shifted; a solenoid valve 7 which is installed in a flow path between the operation lever 8 and the main control valve 4 and is shifted when the float function switch (not illustrated) is turned on; a float valve 9 which is installed in a flow path between the boom spool 4-1 and the boom cylinders 5 and 5*a*, and is shifted by pilot signal pressure, which is applied when the operation lever 8 is operated to make the boom descend in a state where the float function switch is turned on, to make flow paths on the large chamber side and the small chamber side of the boom cylinders 5 and 5*a* communicate with each other so as to return the hydraulic fluid to a hydraulic tank 24; and a holding logic poppet 20 which is mounted in the float valve 9 to prevent an abrupt descending of the boom due to leakage of the hydraulic fluid through a flow path between the main control valve 4 and the float valve 9 during the operation of the boom cylinders 5 and 5*a*.

The holding logic poppet 20 has an inlet side that is joint-connected to the flow path on the large chamber side of the boom cylinders 5 and 5*a* and an outlet side that is joint-connected to a logic path 25 of the float valve 9, and is seated to intercept the logic path 25 by a pressure difference $\Delta P$ due to a difference in cross-sectional area between upper and lower end parts of a poppet 20*a* and an elastic force of a valve spring 22 that elastically supports the upper end part (i.e. an opposite side of a seat part) of the poppet 20*a*.

Figure 1:
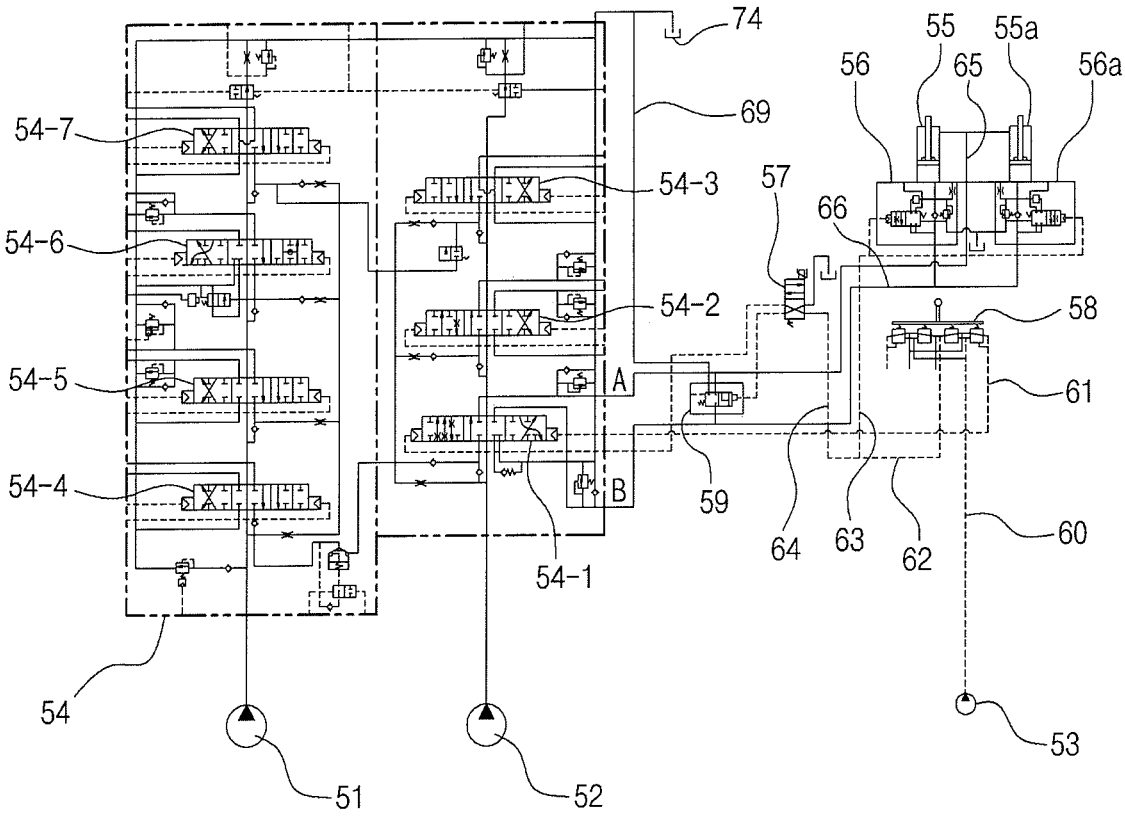
FIG. 1 PRIOR ART
FIG. 1 is a hydraulic circuit diagram of a hydraulic system for construction equipment having a float function in the related art.
Figure 2:
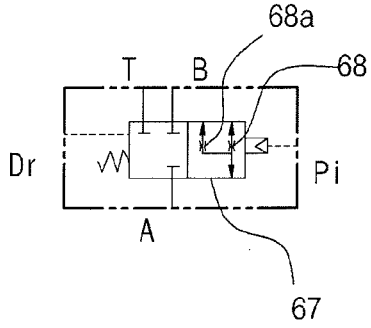
FIG. 2 PRIOR ART
FIG. 2 is an enlarged view of a float valve as illustrated in FIG. 1.

In this case, the construction of the hydraulic system, except for the logic poppet 20 installed inside the float valve 9, which is installed in a flow path between the boom spool 4-1 and the boom cylinders 5 and 5*a*, to prevent an abrupt descending of the boom when leakage of the hydraulic fluid occurs due to damage of a hose between the main control valve 4 and the float valve while the boom cylinders 5 and 5*a* are operated, is substantially the same as the construction of the hydraulic system in the related art as illustrated in FIG. 1, the detailed description of the construction and operation will be omitted.

Hereinafter, the operation of the hydraulic system for construction equipment having a float function according to an embodiment of the present invention will be described with reference to the accompanying drawings.

A) A boom-down operation accompanied with no float function will be described.

In the case of operating the operation lever 8 to a boom-down side, the pilot signal pressure, which is supplied from the pilot pump 3 through the solenoid valve 7, shifts the boom spool 4-1 in a right direction as shown in the drawing. AT this time, the hydraulic fluid that is supplied form the second hydraulic pump 2 is supplied to a port A via the shifted boom spool 4-1, is branched to a port B of the float valve 9, and then is supplied to small chambers of the boom cylinders 5 and 5*a*.

On the other hand, the hydraulic fluids that return from large chambers of the boom cylinders 5 and 5*a* join together, and the joined hydraulic fluid is branched to the port A of the float valve 9 to be connected to the port B of the main control valve 4. Accordingly, the hydraulic fluid returns to the hydraulic tank 24 via the boom spool 4-1 and the internal path of the main control valve 4 to contract the boom cylinders.

The feature of the boom-down operation accompanied with no float function is substantially the same as the feature of the boom-down operation accompanied with no float function in the related art as illustrated in FIG. 1, and the detailed description thereof will be omitted.

B) A boom-down operation accompanied with a float function will be described.

As shown in FIG. 3, when the float function switch is turned on, the solenoid valve 7 is shifted in downward direction as shown in the drawing by an electrical signal from the float function switch. Accordingly, in the case of operating the operation lever 8 to a boom-down side, the pilot signal pressure from the pilot pump 3 passes through the flow path 10, the operation lever 8, and the boom-down side flow path 12, and the shifted solenoid 7, and then shifts a float spool 17 of the float valve 9 in left direction as shown in FIG. 4.

A part of small-chamber side supply lines 15 of the boom cylinders 5 and 5*a* that are connected to the port A of the main control valve 4 is connected to the port B of the shifted float valve 9. The hydraulic fluids returning from the large chambers of the boom cylinders 5 and 5*a* join together in the flow path 16, are connected to the port A of the shifted float valve 9, and then are connected to an inlet of the logic poppet 20. A part of the branched hydraulic fluid is connected to the port B of the main control valve 4.

At this time, the boom spool 4-1 is not shifted to cause the hydraulic fluid not to return to the main control valve 4, while a drain line 23 of an upper end of the logic poppet 20 is connected to a drain line 23*a* via the shifted float spool 17 by the float spool 17 of the float valve 9 that is shifted in left direction.

Since the upper end of the logic poppet 20 is maintained at low pressure, the shifted logic poppet 20 is lifted in downward direction by the high-pressure hydraulic fluids in the large chambers of the boom cylinders 5 and 5*a* of the inlet of the seat part through the port A of the float valve 9. The hydraulic fluids in the large chambers of the boom cylinders 5 and 5*a*, which have flowed into the inlet of the logic poppet 20, are connected to a logical path 25, and the hydraulic fluids in the small chambers of the boom cylinders 5 and 5*a*, which have been connected to the port B of the float valve 9 join the hydraulic fluid which has passed through an orifice 18 inside the float spool 17.

The joined hydraulic fluid is connected to the hydraulic tank 24 via an orifice 18*a* inside the float spool 17, a tank port T, and a tank line 19.

Figure 5:
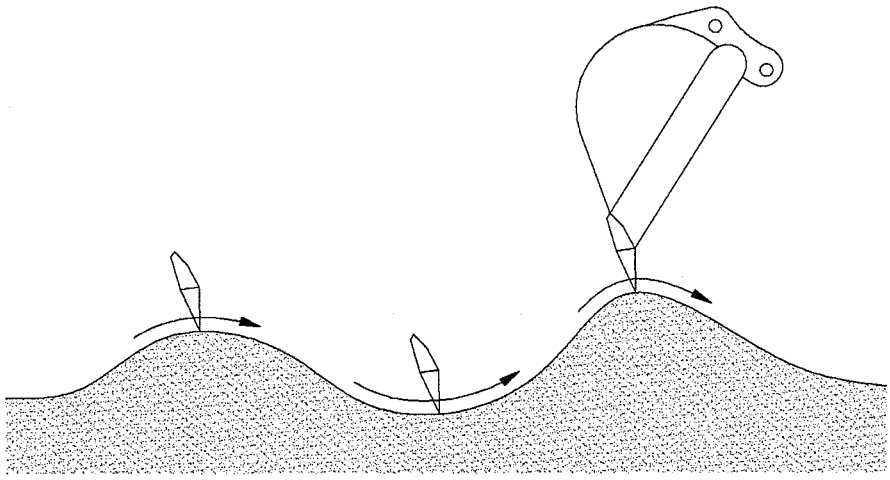
FIG. 5 is a view explaining a float function.

Accordingly, in the case of implementing the float function, the hydraulic fluids in the large chambers and the small chambers of the boom cylinders 5 and 5*a* join together inside the float spool 17 to return to the tank line 19 without supply of the hydraulic fluid through the shifting of the main control valve 4. Accordingly, the ground leveling work by the float function as shown in FIG. 5 can be performed with the operation of the boom due to its own weight during the boom-down operation without generating load.

On the other hand, if the float function switch is turned off, i.e., until the float spool of the float valve 9 is shifted, the high-pressure hydraulic fluids connected to the large chambers of the boom cylinders 5 and 5*a* and the port A of the float value 9 reach the upper part of the poppet 20*a* after passing through an orifice 21 formed inside the poppet 20*a* of the logic poppet 20, but are not connected to a drain. That is, the high-pressure hydraulic fluid shifts the logic poppet 20 to an upper end by pressing the upper part of the poppet 20*a* having a cross-sectional area that is larger than that of the seat part.

Also, the logic poppet 20 is stably seated to be kept in a holding state by the valve spring 22. Accordingly, even if the hydraulic hose positioned between the main control valve 4 and the float valve 9 is damaged, the abrupt descending of the boom cylinders 5 and 5*a* can be prevented by the holding function according to the seat of the logic poppet 20 of the float valve 9.

As described above, even if the hydraulic hose is damaged in the case where the anti-drop valves for preventing the descending of the boom cylinders 5 and 5*a* are not provided, the abrupt descending of the boom can be prevented during the ground leveling operation. Also, the cost-saving float and holding functions, which can stably implement the float function when the float function switch is turned on, can be achieved.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hydraulic system for construction equipment having a float function, comprising:

first and second hydraulic pumps and a pilot pump;

an operation lever which outputs an operation signal in proportion to an amount of operation;

a float function switch which selects a float function;

an arm cylinder, a swing device, and a traveling device which are connected to the first hydraulic pump;

boom cylinders, a bucket cylinder, and a traveling device which are connected to the second hydraulic pump;

a main control valve which is installed in a discharge flow path of the first and second hydraulic pumps, and includes a boom spool that controls a start, stop, and direction change of the boom cylinders when the main control valve is shifted;

a solenoid valve which is installed in a flow path between the operation lever and the boom spool and is shifted when the float function switch is turned on;

a float valve which is installed in a flow path between the boom spool and the boom cylinders, and is shifted by pilot signal pressure, which is applied when the operation lever is operated to make the boom descend in a state where the float function switch is turned on, to make flow paths on the large chamber side and the small chamber side of the boom cylinders communicate with each other so as to return the hydraulic fluid to a hydraulic tank; and a holding logic poppet which is mounted in the float valve to prevent an abrupt descending of the boom due to leakage of the hydraulic fluid through a flow path between the main control valve and the float valve during the operation of the boom cylinders, wherein the holding logic poppet has an inlet side that is joint-connected to the flow path on the large chamber side of the boom cylinders and an outlet side that is joint-connected to a logic path of the float valve, and is seated to intercept the logic path by a pressure difference due to a difference in cross-sectional area between upper and lower end parts of a poppet and an elastic force of a valve spring that elastically supports the upper end part of the poppet.

* * * * *